US006804944B2

(12) United States Patent
Seiki et al.

(10) Patent No.: US 6,804,944 B2
(45) Date of Patent: Oct. 19, 2004

(54) SPINNING MACHINE TRAVELER

(75) Inventors: Kazuo Seiki, Aichi-ken (JP); Koji Maeda, Aichi-ken (JP)

(73) Assignee: Kabushiki Kaisha Yoyota Jidoshokki, Aichi-ken (JP)

( * ) Notice: Subject to any disclaimer, the term of this patent is extended or adjusted under 35 U.S.C. 154(b) by 0 days.

(21) Appl. No.: 10/283,456

(22) Filed: Oct. 30, 2002

(65) Prior Publication Data

US 2003/0087091 A1 May 8, 2003

(30) Foreign Application Priority Data

Nov. 5, 2001 (JP) ..... 2001-338974

(51) Int. Cl.[7] ..... D01H 7/60
(52) U.S. Cl. ..... 57/120; 57/125
(58) Field of Search ..... 57/119, 120, 125

(56) References Cited

U.S. PATENT DOCUMENTS 5,148,662 A * 9/1992 Yamaguchi ..... 57/78
5,187,017 A * 2/1993 Hatano et al. ..... 428/469
5,290,369 A * 3/1994 Hatano et al. ..... 148/230
5,591,023 A * 1/1997 Nakamura et al. ..... 418/179
2002/0162315 A1 * 11/2002 Kagi ..... 57/125

FOREIGN PATENT DOCUMENTS

| | | | |
|---|---|---|---|
| DE | 3633490 | 4/1987 | |
| JP | 63092734 A * | 4/1988 | ..... D01H/7/60 |
| JP | 1-118632 | 5/1989 | |

* cited by examiner

*Primary Examiner*—John J. Calvert
*Assistant Examiner*—Shaun R Hurley
(74) *Attorney, Agent, or Firm*—Knoble Yoshida & Dunleavy

(57) ABSTRACT

A traveler is formed by a base material consisting of hard steel wire, a nitrogen compound layer, and a sulfide layer such that the nitrogen layer is on the base material side. The nitrogen compound layer and the sulfide layer are formed by executing sulphonitriding treatment on the hard steel wire bent into a traveler shape. The borders between the base material, the nitrogen compound layer, and the sulfide layer are diffused. The spinning machine traveler is used without a running-in operation even when spinning operation is performed at an ultra high spindle rotational speed in excess of 25,000 rpm at the initial use of the traveler, and the service life is also elongated.

4 Claims, 5 Drawing Sheets

11 · · · TRAVELER

12 · · · BASE MATERIAL

13 · · · NITROGEN COMPOUND LAYER

14 · · · SULFIDE LAYER

11 · · · TRAVELER

12 · · · BASE MATERIAL

13 · · · NITROGEN COMPOUND LAYER

14 · · · SULFIDE LAYER

12 · · · BASE MATERIAL
13 · · · NITROGEN COMPOUND MATERIAL
14 · · · SULFIDE LAYER
16 · · · SOLID LUBRICANT MATERIAL LAYER

SPINNING MACHINE TRAVELER

BACKGROUND OF THE INVENTION

1. Field of the Invention

The present invention relates to a spinning machine traveler, and more specifically, to a spinning machine traveler which is to be used in a spinning machine, such as a ring spinning machine (ring spinning frame) or a ring twisting machine (ring twisting frame), and which is formed into a predetermined shape by using a hard steel wire or an alloy steel wire.

2. Description of the Related Art

Recently, in ring spinning frames also, there is a demand for an increase in speed to achieve an improvement in productivity, and an ultra-high-speed spinning operation at a spindle RPM of not less than 20,000 rpm has been carried out. As the spindle rotational speed increases, the speed at which the traveler circles on the ring also increases. When the circling speed of the traveler increases, the frictional resistance between the ring and the traveler increases, and wear of the ring and the traveler is expedited, resulting in a rather short service life. Further, when the frictional resistance between the ring and the traveler increases, a large quantity of frictional heat is generated, making the parts themselves subject to damage and deformation and adversely affecting the take-up thread.

JP 7-81216 B discloses a traveler formed of steel wire which has undergone oxynitriding treatment in a gas-nitriding atmosphere in order to achieve an improvement in resistance to wear due to high speed running of the traveler, with a nitrogen compound layer of a thickness of 5 to 30 $\mu$m being formed on the surface of the traveler.

JP 61-446 B discloses a structure in which, in order to achieve an improvement in the initial conformability with the ring, a solid lubricant coating of an epoxy resin containing molybdenum disulfide is formed on the surface of a metal traveler coming into contact with the ring.

Generally speaking, in a ring spinning machine, when the traveler is replaced with a new one, operating the machine from the start so as to attain the maximum rotational speed that is the same as in the normal spinning operation causes thread breakage due to seizure of the traveler, making it impossible to perform the normal operation. In view of this, in order to provide a track allowing the traveler to come into contact with the ring in a correct position at the start of use of the traveler (i.e., to form a worn portion), a running-in operation is executed in which the traveler operates at a rotational speed lower than the normal rotational speed (the rotational speed at the time of normal spinning operation) at the start of use, with the rotational speed being gradually increased.

In the case of the traveler as disclosed in JP 7-81216 B, in which an improvement in wear resistance is achieved by simply enhancing the hardness of the traveler surface, the service life after the formation of an appropriate working surface is relatively long as compared with a traveler which has undergone no wear resistance treatment. However, the initial conformability is rather poor, so that the requisite time for the running-in operation for forming an appropriate track on the traveler is rather long.

Also in the case of the traveler as disclosed in JP 61-446 B, in which an improvement in conformability has been achieved, when it is used in an ultra-high-speed rotation in excess of 20,000 rpm, it is necessary to perform a running-in operation for a long period of time, resulting in a deterioration in productivity and operability. In the case of the traveler as disclosed in JP 7-81216 B, the conformability at the time of ultra-high-speed operation is very poor, so that it is likely to cause thread breakage. Thus, it is of no practical value as a traveler to be used at 20,000 rpm or more.

Thus, to operate a ring spinning machine at ultra-high speed and in a stable manner, it is important that the requisite track allowing the traveler to run in a stable position can be formed without performing any running-in operation and that the slidability of the traveler after the formation of the track be satisfactory.

Generally speaking, in a ring spinning machine, the wear when the metal traveler slides on the metal ring is relatively small despite the fact that the taking-up of the thread is not effected while supplying a special lubricant material onto the slide surface between the traveler and the ring. It is assumed nowadays that this is due to the fact that part of the fiber (fluff) of the thread is detached and supplied onto the slide surface of the traveler, temporarily forming a lubricant film. The lubricant film, once formed, is gradually removed as a result of the gliding of the traveler, but fiber is newly supplied onto the slide surface to form a lubricant film, the cycle being repeated. And, when the attitude of the traveler is unstable, the lubricant film formed is subject to detachment, and in the condition in which there is no lubricant film, the wear of the traveler is expedited. Thus, to reduce the requisite time for the running-in operation, it is necessary for the traveler to be capable of gliding in a stable attitude in an early stage.

Recently, a traveler 20 as shown in FIG. 8 is in use as a traveler helping to enhance the stability in attitude during high speed running. A ring 21 associated with the traveler 20 has on the inner side a tapered surface 21*a* upwardly reduced in diameter and at its upper end an arcuate beveled portion. And, unlike the one formed by bending a steel wire substantially into a C-shape, the traveler 20 is formed of a steel wire to as to exhibit a flat rectangular sectional shape as shown in FIGS. 9A through 9C. It has a flat portion 20*a* capable of coming into slide contact with the tapered surface 21*a* of the ring 21 and a substantially C-shaped lock portion 20*b* connected to one end thereof. FIG. 8 is a partial schematic sectional view showing the relationship between the traveler 20 and the ring 21 associated therewith.

As shown in FIG. 8, during spinning operation, the flat portion 20*a* of this traveler 20 is in contact with the tapered surface of the ring 21 by the action of the centrifugal force; during stop of the spinning operation, the lock portion 20*b* is in contact with the outer surface of the ring 21. FIGS. 9A through 9C are schematic perspective views, of which FIG. 9A shows the traveler 20 with an appropriate track (wear track) 22 formed thereon; FIG. 9B shows the track 22 as formed by excessively wearing away the flat portion 20*a*; and FIG. 9C shows a condition in which the entire portion of the traveler 20 in slide contact with the ring has been excessively worn away.

With the conventional traveler 20, when spinning operation is performed at a spindle rotational speed of 20,000 rpm or more without performing any running-in operation, the states as shown in FIGS. 9B and 9C result, so that running-in operation is indispensable.

When performing ultra-high-speed spinning operation at a spindle rotational speed of 25,000 rpm or more, even if an appropriate track is formed in the early stage through running-in operation, an inappropriate wear as shown in FIGS. 9B and 9C may result depending on the traveler. And, such a traveler is likely to cause thread breakage.

It is necessary that the traveler replacement be effected simultaneously on all the spindles. Because if replacement were effected one by one, starting with the traveler worn in the early stage and frequently causing thread breakage, it would be necessary to reduce the spindle rotational speed for running-in operation each time a traveler is replaced, resulting in a deterioration in productivity. Thus, when the frequency of thread breakage reaches a certain degree, it has been the practice to replace all the travelers simultaneously including the ones whose service life has not expired yet. Thus, when the spindle rotational speed is as high as 25,000 rpm, the traveler replacement cycle is rather short; in the case of a traveler requiring running-in operation, this will lead to a reduction in productivity and bothersome thread breakage control.

SUMMARY OF THE INVENTION

The present invention has been made in view of the above-mentioned problem inherent in the prior art. Therefore, it is an object of the present invention to provide a spinning machine traveler which, even in the case of an ultra-high-speed spinning operation at a spindle rotational speed of 25,000 rpm or more, makes it possible to do away with running-in operation at the start of use of the traveler and which can attain an increase in service life.

To achieve the above-mentioned object, according to a first aspect of the present invention, there is provided a spinning machine traveler formed of steel wire or alloy wire into a predetermined shape, in which there are formed on a base material a nitrogen compound layer and a sulfide layer such that the nitrogen compound layer is on the base material side. The borders between the base material, the nitrogen compound layer, and the sulfide layer are not necessarily clear. The base material is turned into a nitrogen diffusion layer in which nitrogen is diffused at least in the portion thereof near the outer side, and, in many cases, in the vicinity of the border between the nitrogen compound layer and the sulfide layer, the sulfide component is diffused in the nitrogen compound layer.

In this spinning machine traveler, the hardness of the sulfide layer is the lowest, and the hardness of the nitrogen compound layer is the highest. The hardness of the base material is lower than that of the nitrogen compound layer but higher than that of the sulfide layer. When a new traveler is used, an appropriate initial track is formed in the early stage in the outermost, sulfide layer without having to execute running-in operation on the traveler. When the sulfide layer has been worn away, the nitrogen compound layer comes into contact with the ring. In this condition, the sliding force of the traveler is reduced as compared with the prior art, making it possible to perform spinning operation in a more stable manner. As a result, it is possible to perform spinning operation at a desired maximum speed from the start of use and to elongate the service life of the traveler.

According to a second aspect of the invention, there is provided a spinning machine traveler formed of steel wire or alloy wire into a predetermined shape, in which there are formed on a base material a nitrogen compound layer and a sulfide layer such that the nitrogen compound layer is on the base material side, and in which a solid lubricant material layer is formed on the outer surface of the sulfide layer. In this spinning machine traveler, a solid lubricant material layer is formed on the outermost layer of the traveler to exhibit a very small coefficient of friction. Further, its hardness is substantially lower (by one or two orders of magnitude) than that of the sulfide layer, so that the conformability of the traveler in the initial stage of use is improved, an appropriate track is formed in the early stage, and the initial slidability is further stabilized.

According to a third aspect of the invention, there is provided a spinning machine traveler according to the first aspect, in which the nitrogen compound layer and the sulfide layer are formed by sulphonitriding treatment. In this spinning machine traveler, a sulfide layer and a nitrogen compound layer with appropriate hardness can be easily formed.

According to a fourth aspect of the invention, there is provided a spinning machine traveler according to the third aspect, wherein the sulphonitriding treatment is a gas sulphonitriding treatment. In this spinning machine traveler, as compared with the salt bath sulphonitriding treatment, the conditions, etc. can be changed more easily, and no cyanide is required, so that there is no need to handle cyanogen, which is a toxic substance, making it unnecessary to perform cyanogen treatment operation.

DESCRIPTION OF THE PREFERRED EMBODIMENTS

First Embodiment

Figure 1A:
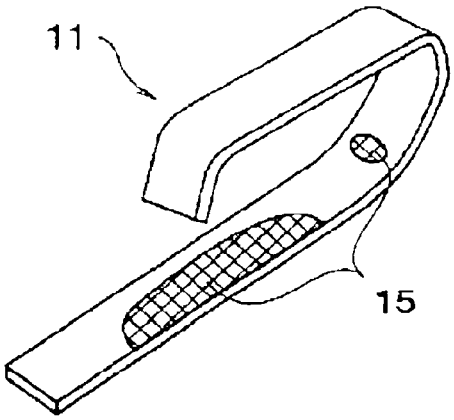
FIG. 1A is a perspective view of a traveler according to a first embodiment.

A first embodiment of the present invention applied to a traveler will now be described with reference to FIGS. 1A through 4. As shown in FIG. 1A, a traveler 11 is formed by bending a hard steel wire, an alloy steel wire or the like into the same shape as that of the conventional inclined type traveler. In this embodiment, a high carbon steel wire is bent and then subjected to quenching and tempering to obtain a traveler. This traveler will be hereinafter referred to as the material traveler.

Figure 1B:
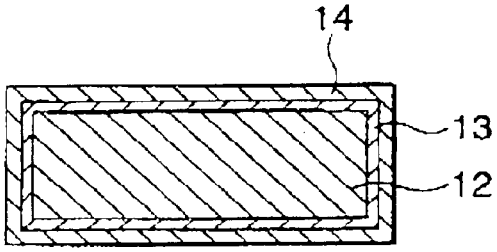
FIG. 1B is a schematic sectional view of the traveler.

And, as shown in FIG. 1B, the traveler 11 is formed by a base material 12 consisting of a hard steel wire, a nitrogen compound layer 13, and a sulfide layer 14 such that the nitrogen compound layer 13 is on the base material 12 side. The nitrogen compound layer 13 and the sulfide layer 14 are formed by performing sulphonitriding treatment on the material traveler. Thus, the borders between the base material 12 and the nitrogen compound layer 13, and between the nitrogen compound layer 13 and the sulfide layer 14 are not necessarily clear. Nitrogen is diffused into at least the portion of the base material 12 near the outer periphery thereof, and into the core depending upon the thickness of the traveler 11, to form a nitrogen diffusion layer. Further, in the vicinity of the border between the nitrogen compound layer 13 and the sulfide layer 14, the sulfide component is diffused in the nitrogen compound layer.

The thickness of the traveler 11 is, for example, 0.4 mm, the thickness of the nitrogen compound 13 is, for example, 10 to 30 $\mu$m, and the thickness of the sulfide layer 14 is, for example, 2 to 5 $\mu$m. When the thickness of the nitrogen compound layer 13 exceeds 30 $\mu$m, the layer becomes fragile, which is undesirable. Making the thickness of the sulfide layer 14 excessively small results in ineffectiveness; on the other hand, making it thick only leads to an increase in cost with little change in effect. The average hardness of the base material (nitrogen diffusion layer) 12 is Hv (Vickers hardness) 450 to 550, that of the nitrogen compound layer 13 is Hv 700 to 900, and that of the sulfide layer 14 is Hv 300 to 400.

In this embodiment, sulphonitriding treatment is executed through a gas sulphonitriding treatment. The gas sulphonitriding treatment is performed at 580° C. with the traveler 11 put in a furnace. The treatment condition is, for example, as follow: for the first one hour, the traveler 11 is kept in an $N_2$ gas atmosphere to uniformly heat the traveler 11. Thereafter, it is kept for four hours in a mixed gas atmosphere consisting of $N_2$ gas, $NH_3$ gas, and $H_2S$ gas to undergo sulphonitriding treatment. Then, it is cooled. The proportion in volume of the mixture gas of $N_2$ gas, $NH_3$ gas, and $H_2S$ gas is 2:4:0.12 to 0.13.

Next, the operation of the traveler 11 formed as described above will be described. The traveler 11 exhibits a satisfactory initial conformability due to the lubricating function of the outermost, sulfide layer 14 having a hardness of Hv 300 to 400. Thus, when the maximum rotational speed of the spindle of the ring spinning frame during normal spinning operation is 20,000 rpm or more, even if spinning operation is performed without running-in operation at the start of use of the traveler 11, a track (wear track) 15 of an appropriate size is formed quickly and in a stable manner.

And, due to the presence of the nitrogen compound layer 13 of a hardness of HV 700 to 900 on the inner side of the sulfide layer 14, the wear resistance of the traveler is improved and the adhesion resistance becomes satisfactory, thereby preventing rapid expansion of the wear track 15. Further, due to the formation of the nitrogen diffusion layer in the base material 12, the slidability and the toughness of the traveler become satisfactory, and even when the nitrogen compound layer 13 has been worn away and the traveler 11 has come into contact with the base material 12, it is possible to maintain a low sliding force for a long period of time and to elongate the service life. Further, due to the intermediate hardness and the satisfactory toughness, the traveler can withstand the impact load at the time of high-speed rotation.

To compare the traveler of the present invention, which is obtained by forming the nitrogen compound layer 13 and the sulfide layer 14 on the inclined type traveler 11 through gas sulphonitriding, with a conventional traveler, sliding force measurement was performed on both.

Figure 2:
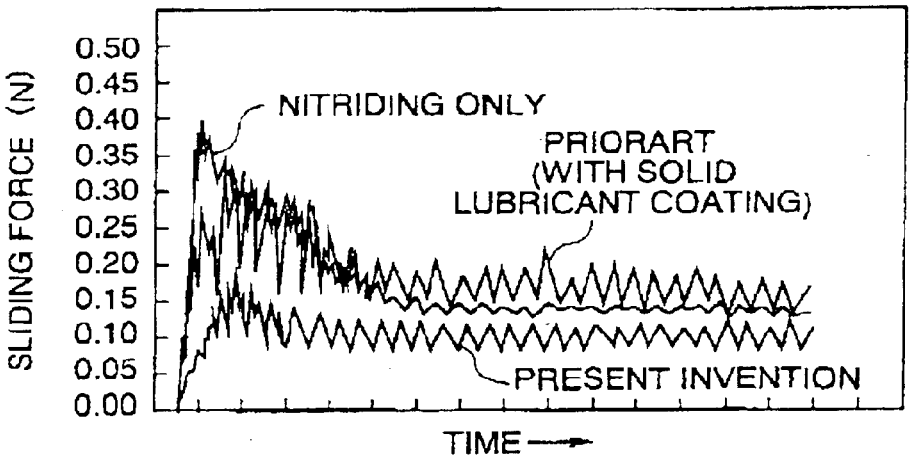
FIG. 2 is a graph showing a variation in initial sliding force of a traveler at the start of use.

Here, the term sliding force refers to the frictional force exerted between the traveler and the ring while the traveler is rotating on the ring. FIG. 2 shows the measurement results obtained at a spindle rotational speed of 25,000 rpm with respect to the traveler of the present invention, a conventional traveler (with a solid lubricant coating), and a traveler which has only undergone nitriding treatment. In the graph, the vertical axis indicates sliding force (in the unit N) and the horizontal axis indicates elapsed time (calibrated in 30 sec.). As is apparent from FIG. 2, in the conventional traveler, the initial sliding force greatly fluctuates in the range of 0.16 to 0.32 N, and it takes long until it becomes stable. In the traveler of the present invention, the fluctuation range is as small as 0.10 to 0.19 N, and it does not take long until the force becomes stable. Further, the average sliding force when stable is approximately 0.12 N, which means a reduction by 25% from that of the conventional traveler, which is approximately 0.16 N. In the case of the traveler which has only undergone nitriding treatment, the initial sliding force is very large, which means it cannot be used in the ultra-high-speed range.

Figure 3:
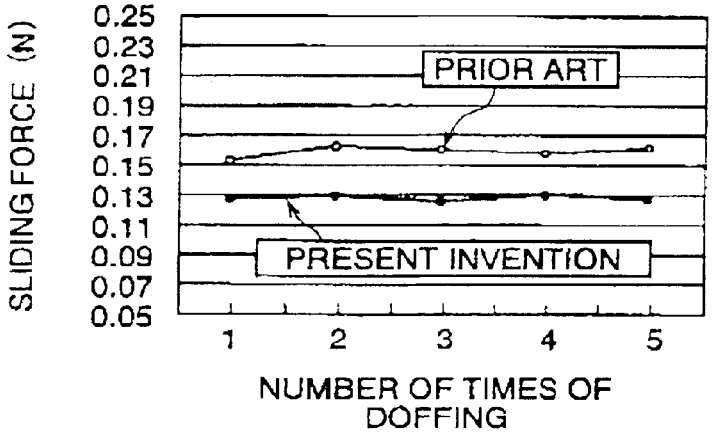
FIG. 3 is a graph showing the relationship between doff number and sliding force from the start of use.

FIG. 3 shows the results of measurement of variations in sliding force when doffing was repeated during spinning operation at a spindle rotational speed of 25,000 rpm on the traveler of the present invention and the conventional traveler (with a slid lubricant coating). The measurement results as obtained after performing doffing five times show that the sliding force of the traveler of the present invention is substantially stable at a level not more than 0.13 N, whereas the sliding force of the conventional traveler is substantially stable at a level of approximately 0.16 N. That is, the traveler of the present invention can maintain a state in which the sliding force is reduced by slightly less than 20% as compared with the conventional traveler.

Figure 4:
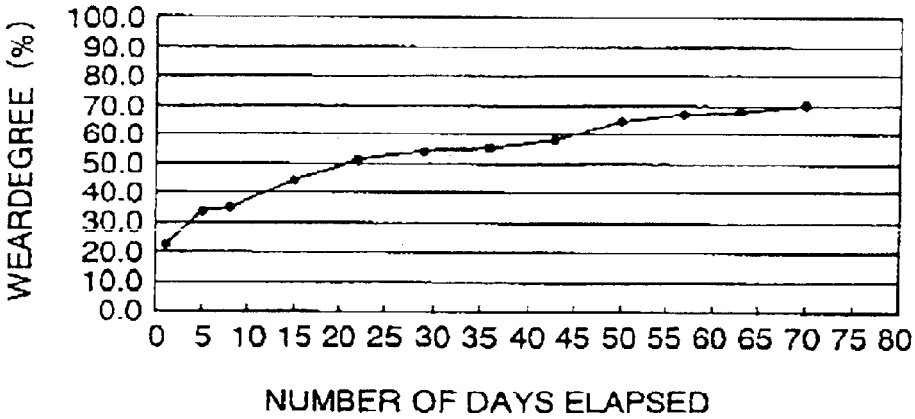
FIG. 4 is a graph showing the relationship between the number of elapsed days and the degree of wear from the start of use.

FIG. 4 shows the results of measurement of variation in wear degree when spinning operation is performed at a spindle rotational speed of 20,000 rpm. Here, the term wear degree refers to the degree of wear when it is assumed that the wear limitation requiring traveler replacement is 100. The measurement result shows that even after elapse of 70 days, which is double the replacement cycle of the conventional traveler, the wear of the traveler 11 is only 70% of the limitation.

This embodiment provides the following advantages:

(1) Since the traveler 11 formed of hard steel wire has as its outermost layer the sulfide layer 14, the initial conformability is satisfactory due to the lubricating function thereof, and even when spinning operation is performed at an ultra-high-speed of 20,000 rpm or more, it is possible to form an appropriate track 15 quickly and in a stable manner.

(2) Due to the presence of the nitrogen compound layer 13 of a hardness of Hv 700 to 900 between the base material 12 and the sulfide layer 14, an improvement is achieved in terms of wear resistance.

(3) Since at least the portion of the base material 12 near the nitrogen compound layer 13 is formed as a nitrogen diffusion layer, it is possible for the traveler to maintain a low sliding force state for a long period of time and to withstand impact load.

(4) Due to the effects (1) through (3), even when spinning operation is performed at an ultra high spindle rotational speed of 25,000 rpm or more, it is possible to do away with running-in operation at the start of use of the traveler 11 and to lengthen the service life. Under the condition of 20,000 rpm, it is possible to secure a service life which is double the service life of the conventional traveler or more.

(5) Since the nitrogen compound layer 13 and the sulfide layer 14 are formed through sulphonitriding treatment, the sulfide layer 14 and the nitrogen compound layer 13 with appropriate hardness can be easily formed. Further, the borders between the base material 12, the nitrogen compound layer 13, and the sulfide layer 14 are not clear, and the layers are formed such that the hardness gradient gradually varies, so that when the sulfide layer 14 or the nitrogen compound layer 13 has been worn away, a rapid change in the sliding force of the traveler 11 is restrained, thus further elongating the service life of the traveler 11.

(6) Since the sulphonitriding treatment is a gas sulphonitriding treatment, the condition, etc. can be changed more easily as compared with salt bath sulphonitriding treatment, and no cyanide is required, so that there is no need to handle cyanogen, which is a toxic substance, and the cyanogen treatment operation becomes unnecessary.

(7) In conducting the sulphonitriding treatment, sulfurizing treatment and nitriding treatment are not conducted separately but in a single process, thereby simplifying the treatment.

Second Embodiment

Figure 5:
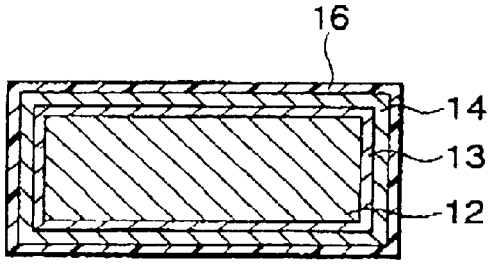
FIG. 5 is a schematic sectional view of a traveler according to a second embodiment.

Next, a second embodiment will be described with reference to FIGS. 5 and 6. As shown in FIG. 5, this embodiment differs from the first embodiment in that a solid lubricant material layer 16 is formed on the outer surface of the sulfide layer 14 of the traveler 11. Otherwise, this embodiment is of the same construction as the first embodiment.

The solid lubricant layer 16 is formed by diffusing a solid lubricant material whose main ingredient is graphite in an epoxy resin and applying the mixture thus obtained to the surface of the traveler 11 which has undergone sulphonitriding treatment as in the first embodiment and baking the solid lubricant material thereto. The application is effected through, for example, tumbler processing.

The Hv Hardness of the Solid Lubricant Layer 16 is Much Less than Several Tens Due to the presence of the outermost, solid lubricant material layer 16, the traveler 11 of this embodiment is improved in lubricating function and initial conformability over the structure whose outermost layer is the sulfide layer 14, so that even when spinning operation is performed at an ultra-high-speed of 25,000 rpm or more, it is possible to form an appropriate track 15 more quickly and in a more stable manner as compared with the first embodiment. As a result, the initial sliding state at a rotational speed of 25,000 rpm or more is further stabilized.

Figure 6:
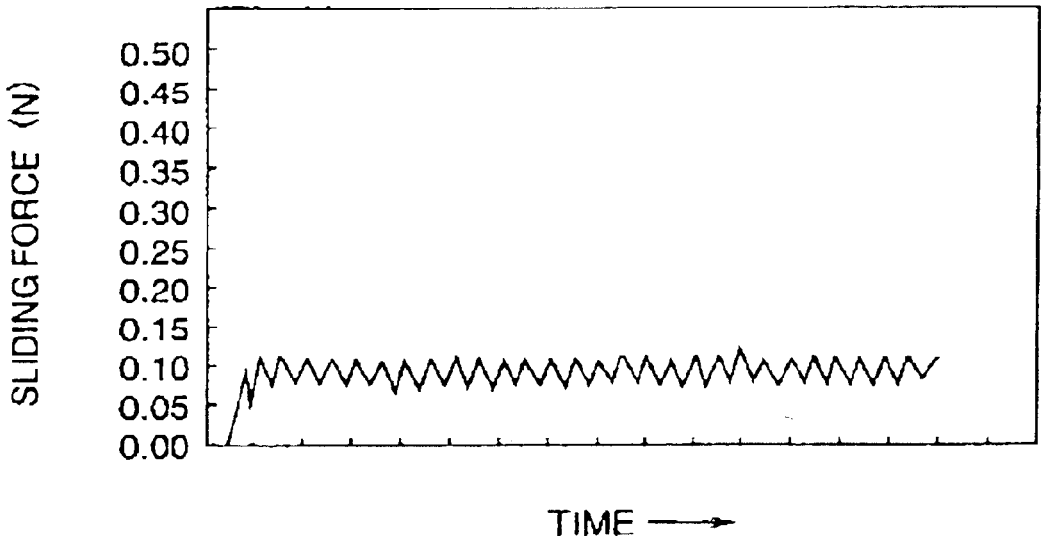
FIG. 6 is a graph showing a variation in the initial sliding force of the traveler at the start of use.

FIG. 6 shows the result of measurement of the sliding force of the traveler 11 at a spindle rotational speed of 25,000 rpm. In the graph, the vertical axis indicates sliding force (in the unit N) and the horizontal axis indicates elapsed time (calibrated in 30 sec.). As is apparent from FIG. 6, in the traveler 11 of this embodiment, there is no great fluctuation in sliding force in the initial stage of use. The average sliding force in the stabilized state is approximately 0.10 N, which means a slight reduction in sliding force as compared with the case of the first embodiment. Thus, the wear resistance of the traveler 11 is further improved.

The above-mentioned embodiments should not be construed restrictively. For example, the following modifications are possible.

The solid lubricant material used when forming the solid lubricant material layer 16 of the second embodiment is not restricted to graphite. It is also possible to use some other solid lubricant material, such as molybdenum disulfide.

As the resin forming the solid lubricant material layer 16, it is also possible to use a thermosetting resin other than epoxy resin.

The method of applying the solid lubricant material layer 16 is not restricted to tumbler processing. It is also possible to adopt spray application.

As the sulphonitriding treatment, it is also possible to adopt salt bath sulphonitriding treatment instead of gas sulphonitriding treatment.

In stead of performing the sulfurizing treatment and the nitriding treatment simultaneously in a single process, it is also possible to perform them in two processes. In this case, a nitrogen diffusion layer is formed in the base material 12. In the vicinity of the border between the nitrogen compound layer 13 and the sulfide layer 14, generation of a region where nitrogen or a nitrogen compound is diffused in the sulfide layer 14 or a region where sulfur or a sulfide is diffused in the nitrogen compound layer 13 does not easily occur.

Figure 7:
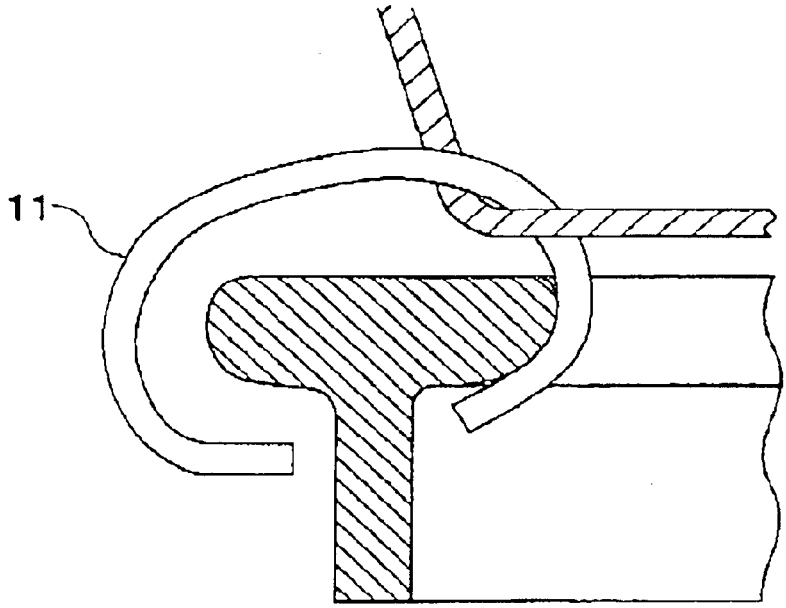
FIG. 7 is a partial enlarged sectional view showing the relationship between another traveler and a ring.
Figure 8:
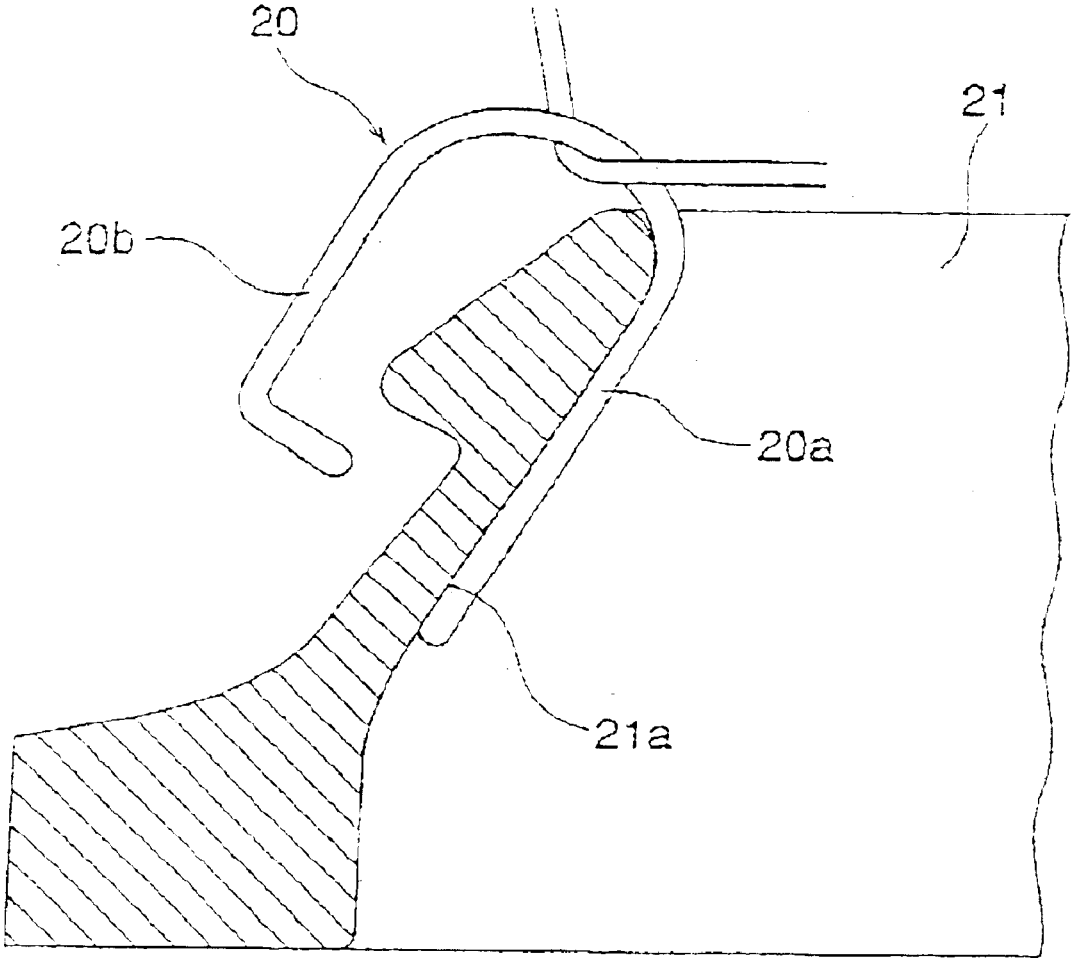
PRIOR ART FIG.8
FIG. 8 is a partial enlarged sectional view showing the relationship between a traveler and a ring.
Figure 9A:
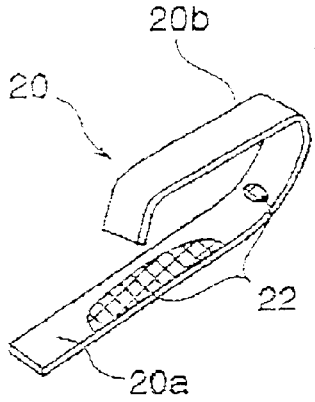
PRIOR ART FIG.9A
FIG. 9A is a schematic perspective view of a traveler with an appropriate track formed thereon.
Figure 9B:
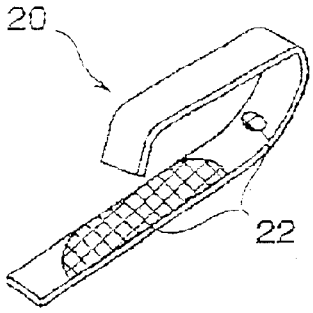
PRIOR ART FIG.9B
FIGS. 9B and 9C are schematic perspective views of travelers with excessive tracks formed thereon.
Figure 9C:
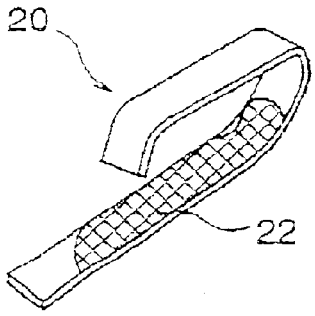
PRIOR ART FIG.9C

The shape of the traveler 11 is not restricted to the inclined one. As shown in FIG. 7, the present invention is also applicable to a C-shaped traveler 11.

The following are the inventions (technical ideas) other than what is claimed as can be grasped from the above-mentioned embodiments:

(1) According to the current invention at least a portion of the base material near the nitrogen compound layer is formed as a nitrogen diffusion layer.

(2) According to the current invention a sulfide component is diffused in a portion of the nitrogen compound layer near the border, and the hardness thereof varies successively.

(3) According to the current invention the, solid lubricant material layer consists of a material obtained by diffusing in epoxy resin a solid lubricant material whose main component is graphite or molybdenum disulfide.

(4) According to the current invention, the sulphonitriding treatment consists of a treatment method in which sulfurizing treatment and nitriding treatment are executed simultaneously.

In the present specification, the nitrogen compound layer 13 does not necessarily consist of a layer formed of a nitrogen compound alone; it may also include a layer having a region where sulfur or a sulfide is diffused. Further, the sulfide layer 14 does not necessarily consist of a layer formed of a sulfide alone; it may also include a layer having a region where nitrogen or a nitride is diffused.

As described in detail above, according to the current invention even when spinning operation is performed at an ultra-high spindle rotational speed of 25,000 rpm or more, it is possible to do away with running-in operation at the start of use of the traveler and to elongate the service life thereof.

What is claimed is:

1. A spinning machine traveler comprising:

a base material consisting of hard steel wire or alloy steel wire and having a first hardness value;

a nitrogen compound layer having a second hardness value and provided on the outer side of the base material; and a sulfide layer having a third hardness value and provided on the outer side of the nitrogen compound layer, the third hardness value being the smallest, the second hardness value being the largest, the first hardness value being between the third hardness value and the second hardness value.

2. A spinning machine traveler according to claim 1, further comprising a solid lubricant material layer provided on the outer side of the sulfide layer.

3. A spinning machine traveler according to claim 1, wherein the nitrogen compound layer and the sulfide layer are formed through sulphonitriding treatment.

4. A spinning machine traveler according to claim 3, wherein the sulphonitriding treatment consists of a gas sulphonitriding treatment.

* * * * *

UNITED STATES PATENT AND TRADEMARK OFFICE

CERTIFICATE OF CORRECTION

PATENT NO. : 6,804,944 B2
DATED : October 19, 2004
INVENTOR(S) : Kazuo Seiki and Koji Maeda It is certified that error appears in the above-identified patent and that said Letters Patent is hereby corrected as shown below:

Title page,
Item [73], Assignee, please change "Yoyota" to read -- Toyota --.

Signed and Sealed this

Fifteenth Day of February, 2005

JON W. DUDAS
*Director of the United States Patent and Trademark Office*